US008766544B2

(12) United States Patent
Velazquez

(10) Patent No.: US 8,766,544 B2
(45) Date of Patent: Jul. 1, 2014

(54) WIRELESS CONTROLLER FOR LIGHTING SYSTEM

(75) Inventor: Toby Velazquez, Yorba Linda, CA (US)

(73) Assignee: American DJ Supply, Inc., Los Angeles, CA (US)

( * ) Notice: Subject to any disclaimer, the term of this patent is extended or adjusted under 35 U.S.C. 154(b) by 145 days.

(21) Appl. No.: 13/394,138

(22) PCT Filed: Sep. 3, 2010

(86) PCT No.: PCT/US2010/047911

§ 371 (c)(1),
(2), (4) Date: Mar. 2, 2012

(87) PCT Pub. No.: WO2011/029066

PCT Pub. Date: Mar. 10, 2011

(65) Prior Publication Data

US 2012/0181935 A1 Jul. 19, 2012

Related U.S. Application Data

(60) Provisional application No. 61/240,070, filed on Sep. 4, 2009.

(51) Int. Cl.
*H05B 37/02* (2006.01)

(52) U.S. Cl.
USPC ..... 315/132; 315/292; 315/152

(58) Field of Classification Search
USPC ..... 315/132, 152, 293, 297, 130, 312
See application file for complete search history.

(56) References Cited

U.S. PATENT DOCUMENTS

| | | | | |
|---|---|---|---|---|
| 6,761,470 | B2 | 7/2004 | Sid | |
| 7,277,024 | B2 | 10/2007 | Chen | |
| 7,405,523 | B2 | 7/2008 | Wilhelm et al. | |
| 2006/0187083 | A1 * | 8/2006 | Lee et al. | 340/825.69 |
| 2010/0045205 | A1 * | 2/2010 | Bergman et al. | 315/294 |
| 2010/0327766 | A1 * | 12/2010 | Recker et al. | 315/291 |
| 2011/0187271 | A1 * | 8/2011 | Bouws et al. | 315/130 |
| 2012/0098432 | A1 * | 4/2012 | Recker et al. | 315/86 |
| 2012/0223646 | A1 * | 9/2012 | Recker et al. | 315/152 |

OTHER PUBLICATIONS

International Search Report and Written Opinion dated Nov. 15, 2010 for International Application No. PCT/ US2010/047911, pp. 1-12, United States Patent and Trademark Office, Virginia, United States.
International Preliminary Report on Patentability and Written Opinion dated Mar. 15, 2012 for International Application No. PCT/ US2010/047911 from International Bureau of WIPO, pp. 1-7, Geneva, Switzerland.

* cited by examiner

*Primary Examiner* — Don Le
(74) *Attorney, Agent, or Firm* — Kenneth L. Sherman, Esq.; Sherman & Zarrabian LLP

(57) ABSTRACT

The present invention provides a system and method for controlling at least one lighting system by means of a portable wireless remote control device. The system comprises a portable wireless remote control device, a lighting system controller, and at least one lighting system coupled to the lighting system controller. Each lighting system comprises one or more lighting modules (e.g., light emitting diodes (LEDs), incandescent bulbs, etc.). The portable wireless remote control device comprises a wireless transceiver, processor, memory, light control logic, user interface (UI), and an antenna. The lighting system controller comprises a wireless transceiver, processor, memory, light control logic, and an antenna. Each lighting system coupled (e.g., wired) to the lighting system controller may be wirelessly controlled via the remote control device.

37 Claims, 7 Drawing Sheets

WIRELESS CONTROLLER FOR LIGHTING SYSTEM

CROSS REFERENCE TO RELATED APPLICATIONS

This application is the U.S. National Phase Patent Application under 35 U.S.C. §371 of International Application Number PCT/US2010/047911, filed on Sep. 3, 2010, which claims priority to U.S. Provisional Patent Application Ser. No. 61/240,070 filed Sep. 4, 2009. Both applications, International Application Number PCT/US2010/047911 and U.S. Provisional Patent Application Ser. No. 61/240,070, are incorporated herein by reference in their entirety.

BACKGROUND OF THE INVENTION

1. Field of the Invention

The present invention relates generally to wireless controllers, and in particular, to a wireless controller for lighting systems.

2. Background of the Invention

Lighting fixtures are used for illuminating environments such as indoor spaces. A typical lighting fixture comprises a housing including a socket for receiving a lighting element such as a light bulb, wherein the socket provides electrical power to the lighting element. Each lighting fixture may be independently installed on a support or mounting surface and coupled to an electrical power source via electrical cables for powering the lighting elements.

BRIEF SUMMARY OF THE INVENTION

The present invention provides a system and method for controlling at least one lighting system by means of a portable wireless remote control device. In one embodiment, the system comprises a portable wireless remote control device, a lighting system controller, and at least one lighting system. Each lighting system comprises one or more lighting modules (e.g., light emitting diodes (LEDs), incandescent bulbs, neon lamps, fluorescent lamps, etc.).

In one embodiment, the portable wireless remote control device comprises a wireless transceiver, processor, memory, light control logic, user interface (UI), and an antenna. The portable wireless remote control device may communicate wirelessly (e.g., radio frequency, infrared frequency, etc.) with the lighting system controller. In a particular embodiment, the user interface is a keypad comprising an indication LED, an all-on button, an all-off button, a standby button, a function button, a mode button, and a plurality of on/off buttons; all for controlling lighting systems coupled to the lighting system controller.

In one embodiment, the lighting system controller comprises a wireless transceiver, processor, memory, light control logic, and an antenna. The lighting system controller may further comprise a means for removably coupling the lighting controller to a surface, at least one output jack for controlling a lighting system coupled thereto, and at least one bank of indication light emitting diodes (LEDs) for indicating a status of each lighting system coupled to the lighting controller. Each lighting system is coupled (e.g., wired) to the lighting system controller and may be powered either by the lighting system controller or an alternative source (e.g., electrical outlet, generator, solar cell, battery, etc.).

These and other features, aspects and advantages of the present invention will become understood with reference to the following description, appended claims and accompanying figures.

DETAILED DESCRIPTION OF THE INVENTION

The following description is made for the purpose of illustrating the general principles of the present invention and is not meant to limit the inventive concepts claimed herein. Further, particular features described within can be used in combination with other described features in each of the various possible combinations and permutations. Unless otherwise specifically defined herein, all terms should be given their broadest possible interpretation including meanings implied from the specification as well as meanings understood by those skilled in the art and/or as defined in dictionaries, treatises, etc.

Embodiments of the invention provide a control system for controlling at least one lighting system. In one embodiment, the control system comprises a lighting controller electrically coupled to each lighting system and a remote control device configured for transmitting control signals to the lighting controller. The lighting controller is configured for receiving control signals from the remote control device and controlling operation of each coupled lighting system based on control signals from the remote control device. In one embodiment, the remote control device transmits control signals to the lighting controller via a wireless communication medium.

Figure 1:
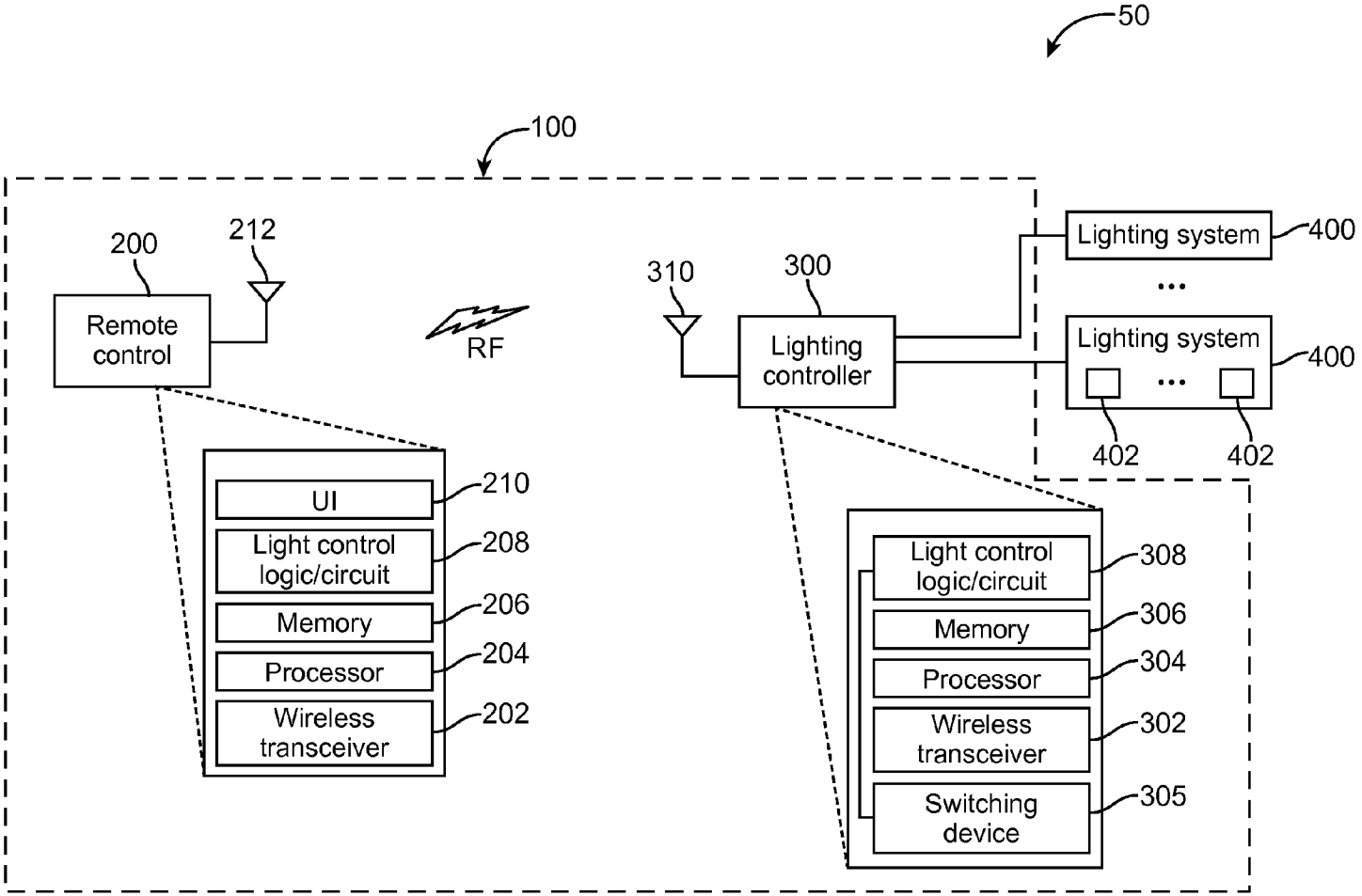
FIG. 1 illustrates a diagram of a wireless controller for a lighting system, according to an embodiment of the present invention.

Referring now to the embodiments of the invention shown in the drawings, FIG. 1 illustrates a system 100 for controlling at least one lighting system 400 by means of a portable wireless remote control device 200, according to an embodiment of the present invention. The system 100 comprises a portable wireless remote control device 200 and a lighting system controller 300. In one embodiment, an apparatus 50 comprises the system 100 and at least one lighting system 400 electrically coupled to the lighting system controller 300.

Each lighting system 400 comprises one or more lighting modules 402 (e.g., light emitting diodes (LEDs), incandescent bulbs, neon lamps, fluorescent lamps, etc.).

In one embodiment of the present invention, the portable wireless remote control device 200 comprises a wireless transceiver 202, processor 204, memory 206, light control logic 208, user interface (UI) 210 (e.g., keypad), and an antenna 212. The portable wireless remote control device 200 communicates with the lighting system controller 300 over a wireless communication medium (e.g., radio frequency (RF), infrared frequency, etc.).

As illustrated in FIG. 1, the lighting system controller 300 comprises a wireless transceiver 302, processor 304, memory 306, light control logic 308, and an antenna 310. Each lighting system 400 is coupled (e.g., wired) to the lighting system controller 300 and may be powered either by the lighting system controller 300 or an alternative source (e.g., electrical outlet, generator, solar cell, battery, etc.).

In one embodiment, the lighting controller 300 includes an electrical switching device (circuit) 305 that is controlled by the control circuit 308 for selectively switching electrical power to each lighting system 400 based on user commands from the remote control device 200. In the example shown in FIG. 2, the electrical switching device 305 is connected between the electrical power input 314 and the power outlets 318 for selectively switching electrical power to each coupled lighting system 400. In the example shown in FIG. 3, the electrical switching device 305 is connected between the electrical power input 314 and the power outlets 326 for selectively switching electrical power to each coupled lighting system 400.

Figure 2:
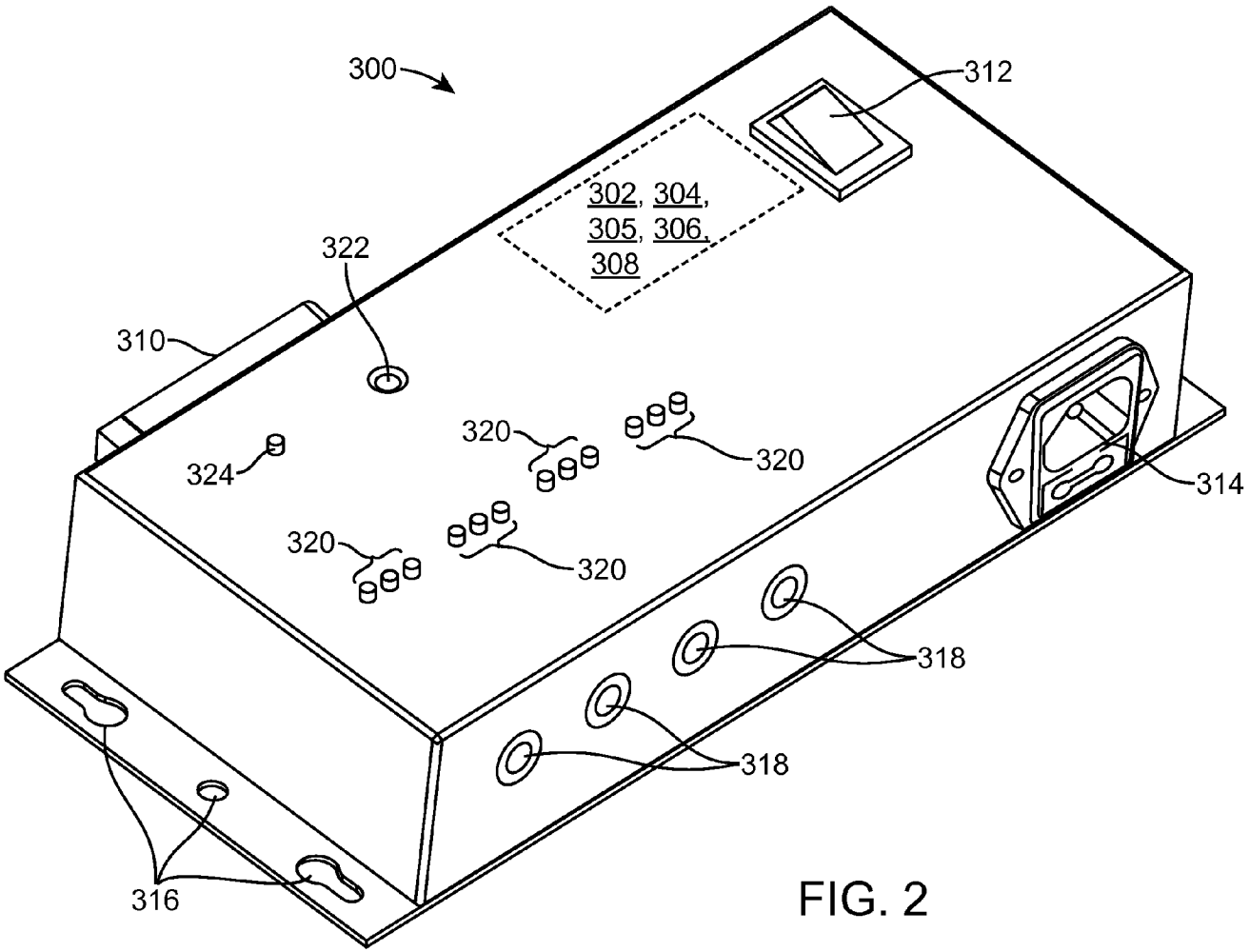
FIG. 2 illustrates a perspective view of a lighting system controller, according to an embodiment of the present invention.

FIG. 2 illustrates a perspective view of a lighting system controller 300, according to an embodiment of the present invention. In this embodiment the controller 300 is essentially rectangular in shape and houses the wireless transceiver 302, processor 304, memory 306, and light control logic/circuits 308. The controller 300 also comprises the antenna 310, a power switch 312, a power cord inlet 314, and coupling member 316 (e.g., apertures) for attaching the lighting system controller 300 to a surface (e.g., wall, ceiling, etc.) via coupling means such as screws, nuts/bolts, etc. In this embodiment the power cord inlet 314 is designed to receive a removable power cord, however it is appreciated that in alternative embodiments a non-removable power cord may be used. The power switch 312 provides a means for turning on/off the lighting system controller 300. The antenna 310 provides the means for communicating with the portable wireless remote control device 200 (FIG. 1).

Moreover, the lighting system controller 300 comprises a plurality of output jacks 318, a plurality of indication light emitting diodes (LEDs) 320, a reset button 322, and a reset indication LED 324. Each output jack in the plurality of output jacks 318 is capable of connecting and controlling at least one lighting system thereto. Each bank of indication LEDs 320 illuminate to indicate the activity status for a given output jack 318. For example, the indication LEDs 320 may identify when a given lighting system is turned on and/or active, when the lighting system is in standby mode, when instructions are being sent to the lighting system, etc. The reset button 322 provides a means of synchronizing the lighting system controller 300 with the portable wireless remote control device 200 (FIG. 1). The reset indication LED provides an indication that the lighting system controller 300 and the portable wireless remote control device are in the process of synchronizing.

In this embodiment, each lighting system connected to the lighting system controller 300 via the output jacks 318 is powered by an external source. In an alternative embodiment, each output jack 318 is also capable of providing power to the lighting system as well as control instructions/signals.

The lighting system controller 300 may be located proximate the lighting systems 400 (e.g., attached to the ceiling near a lighting system, on the same truss component as the lighting system, etc.), wherein an operator (user) may send wireless signals to the lighting system controller 300 via the portable remote control device 200 from a distance without the need for wires/cables running between the remote control 200 and the lighting system controller 300. The portable remote control device 200 allows wireless control (via the lighting system controller 300) one or more lighting systems 400 (FIG. 1) individually or at the same time.

In one embodiment of the present invention, the lighting controller system 300 wirelessly transmits signals comprising status signals back to the portable remote control device 200 (FIG. 1), wherein the status signals may indicate the status of the various lighting systems 400 and or lighting modules 402 (FIG. 1).

In another embodiment of the present invention, each lighting system 400 (FIG. 1) may have a dedicated lighting controller system 300, wherein the lighting controller 400 may be a component part of the lighting controller system 300. As such, a single remote control 200 (FIG. 1) may be used to transmit control function codes to multiple lighting controller systems 300.

In yet another embodiment of the present invention, each lighting system 400 may include logic/programming of lighting sequences for the lighting modules 402 contained therein (FIG. 1). In this scenario, the coupled lighting controller system 300 provides control signals (based on function codes received from the remote control 200) to the lighting system to invoke different lighting programs in the lighting system 400 (desired by an operator of the remote control 200).

Figure 4:
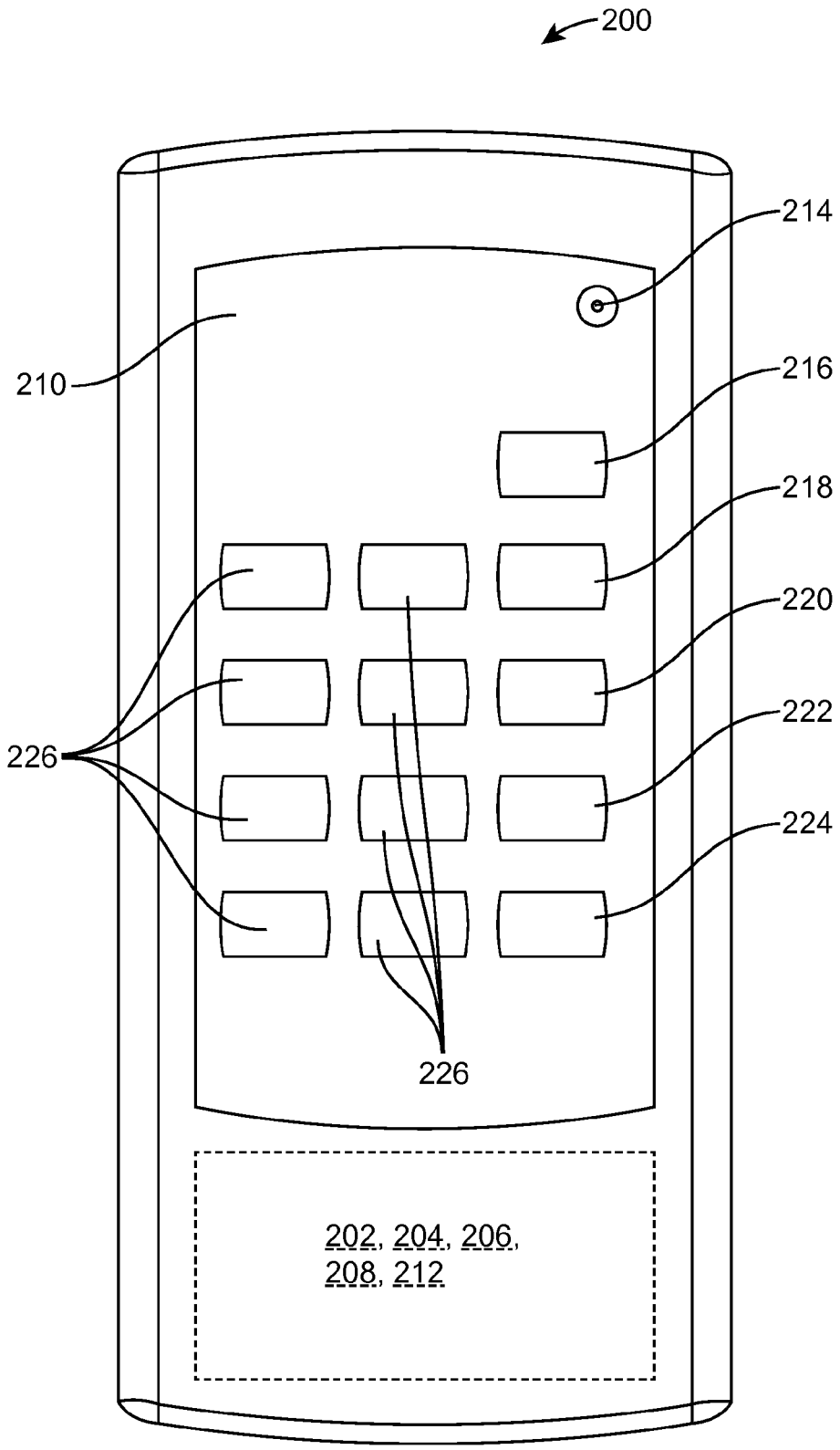
FIG. 4 illustrates a view of a portable remote control, according to an embodiment of the present invention.

FIG. 4 illustrates a view of a portable remote control device 200, according to an embodiment of the present invention. The device 200 is essentially rectangular in shape and comprises the wireless transceiver 202, processor 204, memory 206, lighting control logic/circuits 208, and user interface (UI) 210 in a keypad configuration. In this embodiment, the user interface (UI) 210 comprises an indication LED 214, an all-on button 216, and all-off button 218, a standby button 220, a function button 222, a mode button 224, and a plurality of power jack on/off buttons 226.

The indication LED 214 is designed to blink when a command from the portable wireless controller device 200 has been sent to the lighting system controller 300. The all-on button 216 is designed to turn on all lighting systems connected to the lighting system controller 300 via a power jack 326. The all-off button 218 is designed to turn off all lighting systems connected to the lighting system controller 300 via a power jack 326. The standby button 220 is designed to set all of the lighting systems connected to the lighting system controller 300 via an output jack 318 to a blackout/standby mode.

The function button 222 is designed to cycle through each function (e.g., standby, sound activated, active, etc.) a given lighting system possesses, said lighting system being connected to the lighting system controller 300 via an output jack 318. The mode button 224 is designed to cycle through each mode (e.g., solid, strobe, pattern, etc.) a given lighting system possesses, said lighting system being connected to the lighting system controller 300 via an output jack 318. Finally, the plurality of power jack on/off buttons 226 are designed to turn on and/or off each individual lighting system connected to the lighting system controller 300 via a power jack 326.

The remote control user interface (UI) 210 may alternatively include a display device (e.g., indicator lights, display screen, etc.) to display the received status information in addition to the indication LED 214. The remote control UI 210 may include other input devices instead of, or in addition to, the keypad embodiment illustrated in FIG. 4. Such other input devices may include joy stick, track ball, touch pad, touch screen, etc., for sending control function codes from the remote control 200 to the lighting controller system 300.

With respect to the portable remote control device 200, the lighting control logic/circuits 208 may maintain a look-up table in memory 206 which includes an entry for each key in the user interface (UI) 210, each entry including a key number and a unique control function code. Activating a key causes an associated control function code to be selected and wirelessly transmitted from the portable remote control device 200 to the lighting system controller 300. The lighting system controller 300 receives the control function code from the portable wireless controller 200, and based on the received control function code, the lighting control logic/circuits 308 sends corresponding lighting control signal to a coupled lighting system 400 (FIG. 1).

Each lighting control signal may comprise a sequence or set of signals that controls operation of one or more lighting modules 402 of the lighting system 400 (FIG. 1). For example, a lighting control signal may comprise a programmed sequence of signals for changing on/off status of a first lighting module 402 every N seconds, and changing on/off status of a second lighting module 402 every M seconds, etc. In this example, the lighting control logic/circuits 308 of the lighting controller device 300 includes the various programming of lighting sequences for the lighting modules 402 for desired lighting patterns (FIG. 1).

Figure 3:
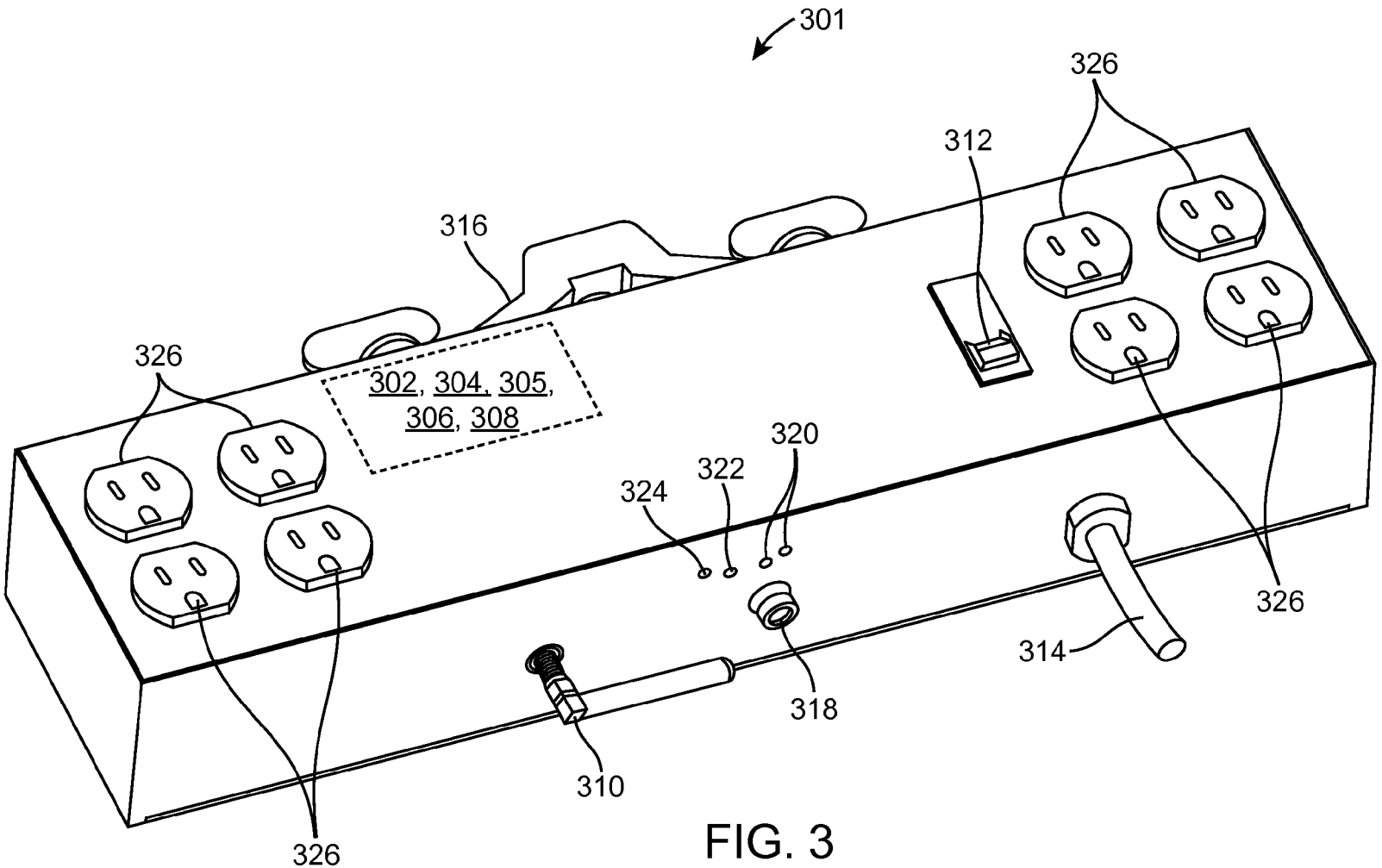
FIG. 3 illustrates a perspective view of an alternative lighting system controller, according to an embodiment of the present invention.

FIG. 3 illustrates a perspective view of an alternative lighting system controller 301, according to an embodiment of the present invention. In this embodiment the lighting system controller 301 is essentially rectangular in shape and comprises the wireless transceiver 302, processor 304, memory 306, and light control logic/circuits 308 as in the lighting system controller 300 in FIG. 1. FIG. 3 further illustrates the antenna 310, power switch 312, power cord inlet 314, and coupling member 316 (e.g., bracket) for attaching the lighting system controller 301 to a surface (e.g., wall, ceiling, truss system, etc.). In this embodiment the power cord 314 is non-removable by design.

The lighting system controller 301 comprises a single output jack 318, two indication light emitting diodes (LEDs) 320, a reset button 322, and a reset indication LED 324. The single output jack 318 is capable of connecting and controlling at least one lighting system thereto. The two indication LEDs 320 light up to indicate the activity status for the lighting system controller 301. For example, the indication LEDs 320 may identify when the system controller 301 is turned on and/or active, when the lighting system controller 301 is in standby mode, etc. In this embodiment, each lighting system connected to the lighting system controller 301 via the output jack 318 is powered by an external source. In an alternative embodiment, the output jack 318 is also capable of providing power to the lighting system as well as control instructions/signals. This alternative embodiment also features a plurality of power jacks 326 capable of providing electrical power to at least eight separate lighting systems.

In another example, a single portable remote control device 200 may be used to selectively transmit control function codes to multiple lighting controller systems. For example, the remote control UI 210 may include a selector button to select which lighting controller systems 300 and 301 should control function codes being transmitted (one at a time, or simultaneously).

Figure 5:
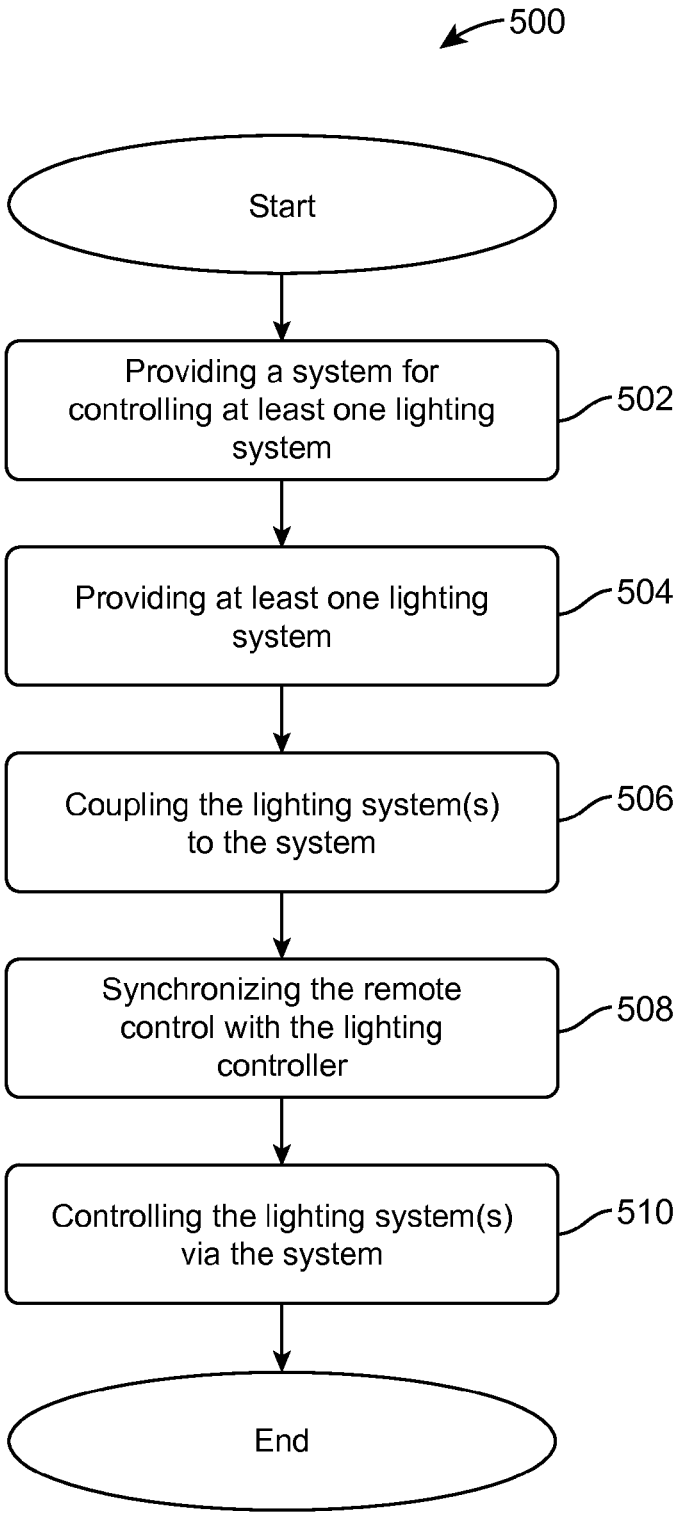
FIG. 5 illustrates a process for controlling at least one lighting system, according to an embodiment of the present invention.

FIG. 5 illustrates a process 500 for controlling at least one lighting system 400 using a remote control device 200 and lighting controller system such as the control lighting system controller 300 in FIG. 1 and the control lighting system controller 301 in FIG. 3, according to embodiments of the present invention. The process 500 begins with process block 502 which comprises providing a system 100 for controlling the lighting system(s) 400 (FIG. 1). The system 100 provided in process block 502 comprises a portable wireless remote control device 200 and a lighting system controller 300.

Process block 504 which comprises providing at least one lighting system 400. In one embodiment of the present invention, the lighting system 400 provided according to process block 504 comprises one or more lighting module 402 (e.g., light emitting diodes (LEDs), incandescent bulbs, neon lamps, fluorescent lamps, etc.).

In one embodiment of the present invention, process block 506 comprises coupling each lighting system 400 to an output jack 318 located on the lighting system controller 300 (FIG. 2). In an alternative embodiment of the present invention, process block 506 comprises coupling each lighting system 400 to a power jack 326 located on the lighting system controller 301 (FIG. 3). Process block 506 is complete after coupling the lighting system(s) 400 to the lighting system controller.

In one embodiment of the present invention, synchronizing the remote control device 200 with the lighting system controller 300 as per process block 508 comprises turning on the lighting system controller 300 via the power switch 312 (FIG. 2). After the controller is turned on, the reset button 322 on the controller 300 is pressed whereupon the reset indication LED 324 begins to flash (FIG. 2). After the reset indication LED 324 begins flashing, any button in the keypad user interface (UI) of the wireless remote control device 200 may be pressed (FIG. 4). Upon pressing a button on the wireless remote control device 200, the indication LED 324 on the lighting controller 300 turns off to indicate that synchronization is successful (FIG. 2). In an alternative embodiment, the reset indication LED 324 may remain on instead of flashing (FIG. 2).

In one embodiment of the present invention, process block 510 comprises controlling the lighting system(s) 400 via the wireless remote control device 200 (FIG. 4). Controlling the lighting system(s) 400 utilizes the user interface (UI) of the remote control device 200 (FIG. 4). In one embodiment, the remote control device 200 user interface (UI) is in a keypad configuration (FIG. 4). Controlling the lighting system(s) 400 may comprise turning on all lighting systems connected to the lighting system controller 300 by pressing the all-on button 216 (FIG. 4). Turning off all the lighting systems may be performed by pressing the all-off button 218 (FIG. 4). Pressing the standby button 220 on the remote control device 200 sets all lighting systems 400 coupled to the lighting system controller 300 to a blackout/standby mode (FIG. 4).

In one embodiment of the present invention, pressing the function button 222 on the remote control device 200 controls the lighting systems 400 by cycling through each function (e.g., standby, sound activated, active, etc.) a given lighting system 400 possesses (FIG. 4). Pressing the mode button 224 on the remote control device 200 controls the lighting systems 400 coupled to the lighting system controller 300 by cycling through each mode (e.g., solid, strobe, pattern, etc.) a given lighting system possesses (FIG. 4). Additionally, the lighting system(s) 400 may be individually turned on and/or off by pressing a corresponding on/off button 226 on the wireless remote control device 200 (FIG. 4).

Figure 6B:
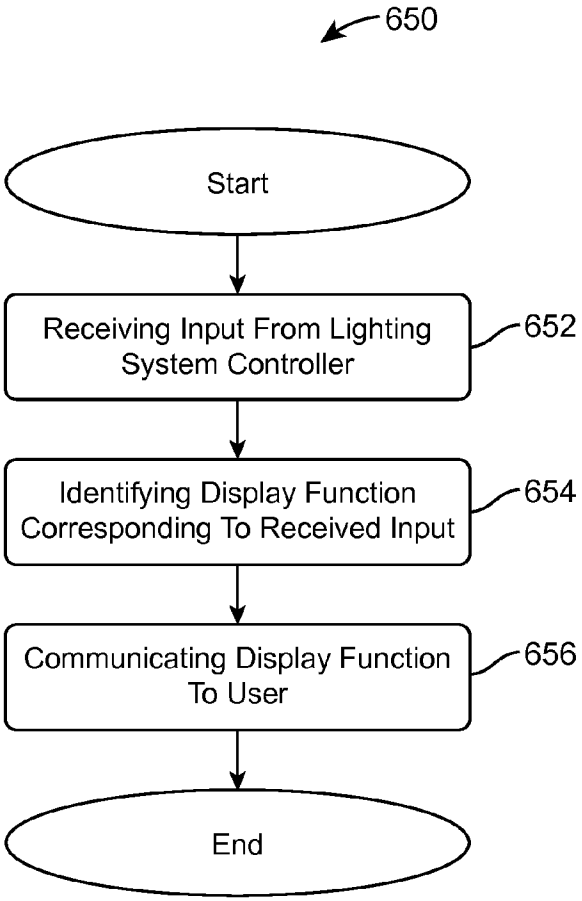
FIG. 6B illustrates an alternative process for controlling at least one lighting system, according to an embodiment of the present invention.
Figure 6A:
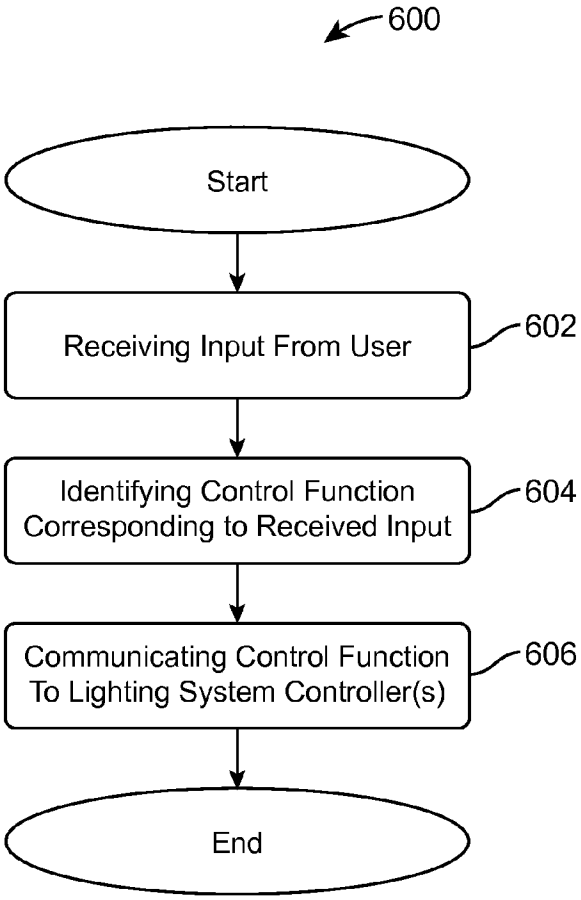
FIG. 6A illustrates an alternative process for controlling at least one lighting system, according to an embodiment of the present invention.

FIG. 6A illustrates flowchart of a process 600 providing example details of the control process 510 (FIG. 5) for controlling at least one lighting system 400 (FIG. 1), according to an embodiment of the present invention. Process block 602 comprises the remote control device 200 (FIG. 1) receiving input from a user. The process 600 may be implemented by the control logic 208, according to an embodiment of the invention.

The remote control device 200 receiving input from a user may comprise, for example, a user pressing a button on a keypad on the remote control device 200 (FIG. 4). Alternatively, input from the user may comprise the user pressing multiple buttons on the remote control device 200 (FIG. 4), speaking into a microphone located on the remote control device 200, etc.

Process block 604 comprises the remote control device 200 identifying a specific control function corresponding to the input received from the user. In one embodiment, each button in the keypad configured user interface 210 maps to a corresponding control function in a look-up table stored in memory 206 (FIG. 1). In one example, process block 604 uses the processor 204 and/or control logic/circuits 208 in the remote control device 200 to identify the specific control function in the look-up table in memory 206 that corresponds to the input received from the user (FIG. 1).

Process block 606 comprises the remote control device 200 communicating the identified control function to at least one lighting system controller such as the lighting system controller 300 (FIG. 1). In one embodiment, the wireless transceiver 202 utilizes the antenna 212 to wirelessly communicate the identified control function to the lighting system controller 300 (FIG. 1).

Further, the remote control device 200 may wirelessly receive information from each lighting system controller 300. FIG. 6B illustrates a flowchart of such a process 650 for controlling 510 (FIG. 5) at least one lighting system 400 (FIG. 1), according to an embodiment of the present invention. Process 652 comprises the remote control device 200 receiving information from a lighting system controller 300.

In one embodiment, input from the lighting system controller 300 is received by the antenna 212 and interpreted using the wireless transceiver 202 and processor 204 (FIG. 1). Such information may include, for example: acknowledgment from the lighting system controller 300 in response to a control signal sent from the remote control device 200 (e.g., control signal received, error, etc.), the status of the lighting system controller 300, the status of one or more lighting systems 400 electrically coupled to the lighting system controller 300, the status of one or more lighting elements 402, etc. (FIG. 1).

The remote control device 200 may display information based on said information received from the remote control system 300. For example, process block 654 comprises identifying a specific display information corresponding to the information received from the lighting system controller 300 (FIG. 1). In one embodiment, each button in the keypad 210 is capable of displaying a certain pattern(s) (e.g., flash, blink, strobe, solid color, etc.) to a user based on information received from the lighting system controller 300. The capable display pattern(s) for each button may be stored in a look-up table residing in memory 206 (FIG. 1). Process block 654 uses the processor 204 and control logic/circuits 208 (FIG. 1) to identify the specific keypad button and display pattern in the look-up table corresponding to the information received from the lighting system controller 300.

Process block 656 comprises the remote control device 200 communicating the display information to the user (FIG. 4). In one embodiment, communicating comprises the remote control device 200 displaying the pattern on the identified keypad button in the user interface 210 of the remote control device 200 (FIG. 1) corresponding to the received information. In an alternative embodiment, communicating may comprise displaying words and/or images on a display screen located in the remote control device 200 (FIG. 1). Additionally communicating may comprise playing an audio file stored in memory 206 through a speaker located in the remote control device 200.

Figure 7B:
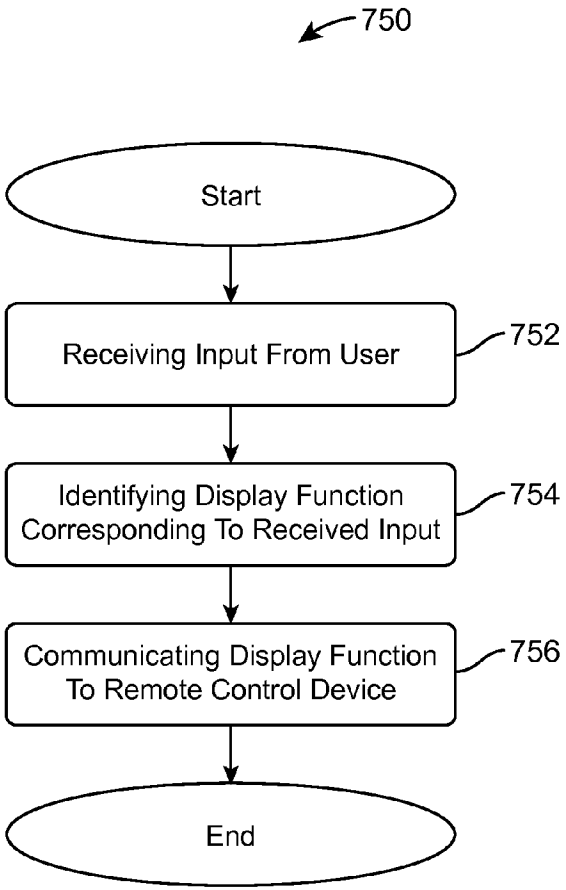
FIG. 7B illustrates an alternative process for controlling at least one lighting system, according to an embodiment of the present invention.
Figure 7A:
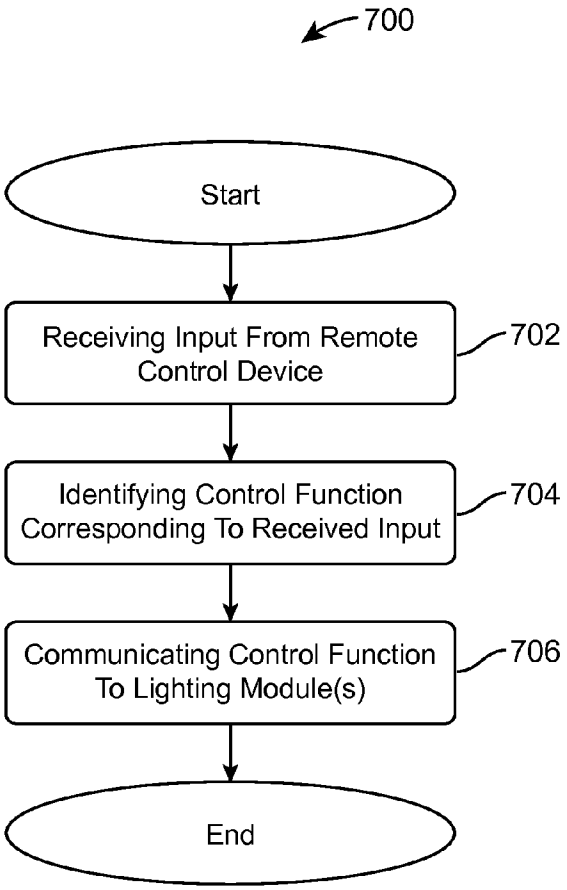
FIG. 7A illustrates an alternative process for controlling at least one lighting system, according to an embodiment of the present invention.

FIG. 7A illustrates flowchart of a process 700 for controlling 510 (FIG. 5) at least one lighting system 400 (FIG. 1), according to an embodiment of the present invention. The process 700 may be implemented by the control logic 308 of a lighting controller system 300, according to an embodiment of the invention.

Process block 702 comprises the lighting system controller 300 receiving input from a remote control device 200 (FIG. 1). In one embodiment, input from the remote control device 200 is received by the wireless transceiver 302 and interpreted using the control logic 308 and/or processor 304 in the lighting system controller 300 (FIG. 1).

Process block 704 comprises the lighting system controller 300 identifying a specific control function corresponding to the input received from the remote control device 200 (FIG. 1). In one embodiment, a lighting system 400 is capable of displaying certain patterns and/or sequences (e.g., flash, blink, strobe, solid color, pattern, audio activated, etc.), based on control signals received from a coupled lighting system controller 300. In another embodiment, output jacks 318 and power jacks 326 in a lighting system controller 300 (FIG. 2) are capable of communicating operations and/or commands (e.g., turn on, turn off, enter standby mode, self-test, etc.) to lighting system(s) 400 connected thereto (FIG. 1).

In one example, while lighting systems 400 coupled to a power jack 326 may only be capable of on/off operations; lighting systems 400 coupled to an output jack 318 of the lighting system controller 300 (FIG. 3) may be capable of additional operations, for example, entering certain modes (e.g., standby, strobe, solid light, flicker, fade in/out, etc.). In one embodiment, the operation(s) for each output jack 318 and power jack 326 in a lighting system controller 300 are stored in a look-up table stored in memory 306 (FIG. 1).

Processor 304 of the lighting system controller 300 uses control logic/circuits 308 and the look-up table in memory 306 to identify (select) a specific jack (e.g., output jack 318 or power jack 326) and display operation corresponding to the input received from the remote control device 200 (FIG. 1).

Process block 706 comprises the lighting system controller 300 communicating the identified display operation via the identified jack (output jack 318 or power jack 326) to at least one lighting system 400 (FIG. 1) coupled thereto.

Additionally, the lighting system controller 300 is capable of receiving information from a user directly, wherein the user may initiate, for example, synchronizing/re-synchronizing communication between a remote control device 200 and the lighting system controller 300 (FIG. 1). FIG. 7B illustrates a flowchart of such a process 750 for controlling 510 (FIG. 5) at least one lighting system 400 (FIG. 1), according to an embodiment of the present invention. The user may initiate process block 752 by pressing the reset button 322 on the lighting system controller 300 thereby sending an input signal to the controller 300 (FIG. 2).

Process block 754 comprises the lighting system controller 300 identifying the display function to send to the remote control device 200 corresponding to the input received from the user at the lighting system controller 300 (FIG. 1). In one embodiment, display functions that can be sent to the remote control device 200 reside in a look-up table stored in memory 306 and may include, for example, that the indication LED 214 on the remote control device 200 (FIG. 4) illuminates or blinks during synchronization. Process block 754 uses the processor 304 and control logic/circuits 308 (FIG. 1) to identify the specific display function in the look-up table corresponding to the input received from the user at the lighting system controller 300.

Process block 756 comprises the lighting system controller 300 communicating the identified display function to the remote control device 200 (FIG. 2). In one embodiment, the wireless transceiver 302 of the lighting system controller 300 utilizes the antenna 310 to wirelessly communicate the identified display function to the remote control device 200 (FIG. 1) for display thereon.

As is known to those skilled in the art, the aforementioned example architectures described above, according to the present invention, can be implemented in many ways, such as program instructions for execution by a processor, as software modules, as microcode, as computer program products on computer readable media, as logic circuits, as application specific integrated circuits, as firmware, etc. Further, embodiments of the invention can take the form of an entirely hardware embodiment, an entirely software embodiment or an embodiment containing both hardware and software elements.

The present invention has been described in considerable detail with reference to certain preferred versions thereof; however, other versions are possible. Therefore, the spirit and scope of the appended claims should not be limited to the description of the preferred versions contained herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A control system for controlling at least one lighting system, comprising:

a lighting controller detachably electrically coupled to each lighting system; and a remote control device configured for transmitting control signals to the lighting controller;

wherein the lighting controller is configured for receiving control signals from the remote control device and controlling operation of each coupled lighting system based on control signals from the remote control device; and wherein, for each lighting system coupled to the lighting controller, the lighting controller is further configured for cycling through one or more of lighting functions and one or more lightings modes of the lighting system.

2. The control system of claim 1, wherein the lighting controller comprises:

a communication module configured for wireless communication with the remote control device over a wireless communication medium;

a lighting control logic configured for controlling operation of each coupled lighting system; and at least one output jack for controlling a lighting system coupled thereto.

3. The control system of claim 2, wherein:

the lighting control logic is further configured for controlling operation of a coupled lighting system based on a received control function code from the remote control device, wherein the lighting control logic sends a corresponding lighting control signal to a coupled lighting system.

4. The control system of claim 3, wherein:

the lighting control logic is further configured to generate a lighting control signal comprising a set of signals that control operation of one or more lighting modules of the coupled lighting system, based on control signals received from the remote control device.

5. The control system of claim 2, wherein the lighting controller further comprises:

a coupling mechanism for removably coupling the lighting controller to a surface; and at least one display device for visually indicating a status of each lighting system coupled to the lighting controller.

6. The control system of claim 2, wherein the lighting controller further comprises:

a synchronization button for synchronizing the remote control device with the lighting controller;

a synchronization LED for indicating whether the remote control device is synchronized with the lighting controller; and at least one electrical power jack for providing electricity to a lighting system coupled thereto.

7. The control system of claim 6, wherein the coupling mechanism comprises:

a plurality of apertures for coupling the lighting controller to a surface by nuts and bolts.

8. The control system of claim 7, wherein the coupling mechanism comprises:

a clamp for coupling the lighting controller to a truss system.

9. The control system of claim 7, wherein the remote control device comprises:

a communication module configured for wireless communication with the lighting controller via a wireless communication medium;

a user interface configured for receiving user commands for commanding operation of each lighting system via the lighting controller; and a control logic configured for selectively transmitting control signals to the lighting controller based on user commands received via the user interface.

10. The control system of claim 9, wherein the user interface comprises a keypad for receiving commands for operation of each lighting system.

11. The control system of claim 10, wherein the user interface comprises:

an indication LED;

an all-on button;

an all-off button;

a standby button;

a function button;

a mode button; and a plurality of on/off buttons.

12. The control system of claim 11, wherein the indication LED of the remote control device is configured for indicating when signals are sent to or received from the lighting controller.

13. The control system of claim 11, wherein the all-on button of the remote control device is configured for turning on all lighting systems coupled to the lighting controller via a power jack by sending a control signal from the remote control device to the lighting controller.

14. The control system of claim 11, wherein the all-off button of the remote control device is configured for turning off all lighting systems coupled to the lighting controller via a power jack by sending a control signal from the remote control device to the lighting controller.

15. The control system of claim 11, wherein the standby button of the remote control device is configured for setting all lighting systems coupled to the lighting controller via an output jack to a standby mode by sending a control signal from the remote control device to the lighting controller.

16. The control system of claim 11, wherein:

the function button of the remote control device is configured for cycling through each lighting function a lighting system possesses by sending a control signal from the remote control device to the lighting controller, wherein the lighting system is coupled to the lighting controller via an output jack; and wherein each lighting system has at least one of the following lighting functions: standby, a sound activated, and active.

17. The control system of claim 11, wherein:

the mode button of the remote control device is configured for cycling through each lighting mode a given lighting system possesses by sending a control signal from the remote control device to the lighting controller, wherein the lighting system is coupled to the lighting controller via an output jack; and wherein each lighting system has at least one of the following lighting modes: a solid, strobe and pattern.

18. The control system of claim 11, wherein each on/off button of the remote control device is configured to turn on or turn off each lighting system coupled to the lighting controller via a power jack by sending a control signal from the remote control device to the lighting controller.

19. The control system of claim 5, wherein the remote control device is configured for sending signals to and receiving signals from more than one lighting controller.

20. The control system of claim 19, wherein the remote control device is configured for controlling each of the lighting devices coupled to the lighting controller individually.

21. The control system of claim 20, wherein the remote control device is configured for controlling all of the lighting devices coupled to the lighting controller at once.

22. The control system of claim 11, wherein the remote control device is further configured for receiving signals from a lighting controller and displaying information based on the signals received from said lighting controller.

23. A method for wirelessly controlling at least one lighting system, comprising:

providing a control system for controlling the at least one lighting system;

providing at least one lighting system;

electrically coupling each lighting system to the control system; and controlling each lighting system coupled to the control system;

wherein, for each lighting system coupled to the control system, the control system is configured for cycling through one or more of lighting functions and one or more lightings modes of the lighting system.

24. The method of claim 23, wherein the control system comprises:

a lighting controller detachably electrically coupled to each lighting system;

a remote control device configured for transmitting control signals to the lighting controller;

wherein the lighting controller is configured for receiving control signals from the remote control device and controlling operation of each coupled lighting system based on control signals from the remote control device.

25. The method of claim 24, further comprising:

synchronizing the remote control device with the lighting controller prior to controlling each lighting system coupled to the control system.

26. The method of claim 25, wherein the lighting controller comprises:

a communication module configured for wireless communication with the remote control device over a wireless communication medium;

a lighting control logic configured for controlling operation of each coupled lighting system;

at least one output jack for controlling a lighting system coupled thereto;

a coupling mechanism for removably coupling the lighting controller to a surface; and at least one display device for visually indicating a status of each lighting system coupled to the lighting controller;

wherein the lighting control logic is further configured for controlling operation of a coupled lighting system based on a received control function code from the remote control device, wherein the lighting control logic sends a corresponding lighting control signal to a coupled lighting system; and wherein the lighting control logic is further configured to generate a lighting control signal comprising a set of signals that control operation of one or more lighting modules of the coupled lighting system, based on control signals received from the remote control device.

27. The method of claim 26, wherein the remote control device comprises:

a communication module configured for wireless communication with the lighting controller via a wireless communication medium;

a user interface configured for receiving user commands for commanding operation of each lighting system via the lighting controller; and a control logic configured for selectively transmitting control signals to the lighting controller based on user commands received via the user interface;

wherein the user interface comprises a keypad for receiving commands for operation of each lighting system; and wherein an indication display of the remote control device is configured for indicating when signals are sent to or received from the lighting controller.

28. The method of claim 26, wherein controlling each lighting system comprises:

in response to a mode button of the remote control device being pressed, cycling through each mode a given lighting system possesses by sending a control signal from the remote control device to the lighting controller, wherein the lighting system is coupled to the lighting controller via an output jack; and in response to each on/off button of the remote control device being pressed, turning on or turning off each lighting system coupled to the lighting controller via a power jack by sending a control signal from the remote control device to the lighting controller.

29. The method of claim 26, wherein the remote control device is further configured for receiving signals from a lighting controller and displaying information based on the signals received from said lighting controller.

30. A lighting apparatus, comprising:

at least one lighting system; and a control system comprising:

a lighting controller detachably electrically coupled to each lighting system; and a remote control device configured for wirelessly communicating with the lighting controller via a wireless communication medium;

wherein the lighting controller is configured for receiving control signals from the remote control device and controlling operation of each coupled lighting system based on control signals from the remote control device; and wherein, for each lighting system coupled to the lighting controller, the lighting controller is further configured for cycling through one or more of lighting functions and one or more lightings modes of the lighting system.

31. The apparatus of claim 30, wherein the lighting controller comprises:

a communication module configured for wireless communication with the remote control device over a wireless communication medium;

a lighting control logic configured for controlling operation of each coupled lighting system; and at least one output jack for controlling a lighting system coupled thereto.

32. The apparatus of claim 31, wherein:

the lighting control logic is further configured for controlling operation of a coupled lighting system based on a received control function code from the remote control device, wherein the lighting control logic sends a corresponding lighting control signal to a coupled lighting system.

33. The apparatus of claim 32, wherein:

the lighting control logic is further configured to generate a lighting control signal comprising a set of signals that control operation of one or more lighting modules of the coupled lighting system, based on control signals received from the remote control device.

34. The apparatus of claim 33, wherein the remote control device comprises:

a communication module configured for wireless communication with the lighting controller via a wireless communication medium;

a user interface configured for receiving user commands for commanding operation of each lighting system via the lighting controller; and a control logic configured for selectively transmitting control signals to the lighting controller based on user commands received via the user interface.

35. The apparatus of claim 34, wherein the remote control device is further configured for receiving signals from a lighting controller and displaying information based on the signals received from said lighting controller.

36. The control system of claim 1, wherein:

each lighting system is individually connected to the lighting controller.

37. The control system of claim 1, wherein:

the lighting controller is separately proximate to each lighting system.

* * * * *